US005206962A

United States Patent [19]

Thorwaldson

[11] Patent Number: 5,206,962

[45] Date of Patent: May 4, 1993

[54] WASTE WATER DISPOSAL SYSTEM FOR RECREATIONAL VEHICLE

[76] Inventor: Waldemar S. Thorwaldson, 2332 S. Peck Rd., Room 268, Whittier, Calif. 90601

[21] Appl. No.: 704,284

[22] Filed: May 21, 1991

[51] Int. Cl.[5] ..... E03D 5/00

[52] U.S. Cl. ..... 4/323; 4/415

[58] Field of Search ..... 4/665, 321, 322, 323, 4/340, 341, 415; 134/166, 171, 186, 60, 104.1; 220/562, 564, 23.2, 23.4, 23.83; 296/156, 168, 164; 280/830, 834

[56] References Cited

U.S. PATENT DOCUMENTS

| | | | |
|---|---|---|---|
| 588,609 | 8/1897 | Smead | 4/340 |
| 1,607,257 | 11/1926 | Gaulke | 4/340 X |
| 2,817,091 | 12/1957 | Painter | 4/323 X |
| 3,183,525 | 5/1965 | O'Brien et al. | 4/341 X |
| 3,318,449 | 5/1967 | Jennings et al. | 4/665 |
| 3,594,825 | 7/1971 | Reid | 4/323 |
| 3,666,106 | 5/1972 | Green | 4/323 X |
| 3,843,976 | 10/1974 | Miya et al. | 4/415 X |
| 3,931,907 | 1/1976 | Henle | 220/564 X |
| 3,974,528 | 8/1976 | Claunch et al. | 4/323 |
| 4,156,297 | 5/1979 | Pilolla | 4/320 |
| 4,162,218 | 7/1979 | McCormick | 4/665 |
| 4,242,765 | 1/1981 | Russell | 4/321 |
| 4,550,453 | 11/1985 | Norman | 4/323 |
| 4,667,351 | 5/1987 | Williams | 4/323 |
| 4,728,144 | 3/1988 | Crean | 4/321 X |
| 4,868,932 | 9/1989 | Thoma et al. | 4/323 |

FOREIGN PATENT DOCUMENTS

| | | | |
|---|---|---|---|
| 0274460 | 7/1988 | European Pat. Off. | 296/156 |
| 0427213 | 5/1991 | European Pat. Off. | 4/665 |
| 2521612 | 8/1983 | France | 4/665 |
| 0160041 | 12/1979 | Japan | 4/321 |
| 0088827 | 3/1990 | Japan | 4/321 |

OTHER PUBLICATIONS

Thetford Corporation "RV Sanitation . . . from the inside out.". Feb. '88, Form No. 14902.

Thetford Corporation "Product Information" booklet Sep., '88.

"Trailer Life's RV Repair & Maintenance Manual," pp. 78 and 79.

*Primary Examiner*—William A. Cuchlinski, Jr.
*Assistant Examiner*—John L. Beres
*Attorney, Agent, or Firm*—Roberts and Quiogue

[57] ABSTRACT

A waste water disposal system for recreational vehicles. When emptying the black and grey water holding tanks, grey water is emptied into the black water holding tank, thereby helping to flush solids out of the black water holding tank.

11 Claims, 2 Drawing Sheets

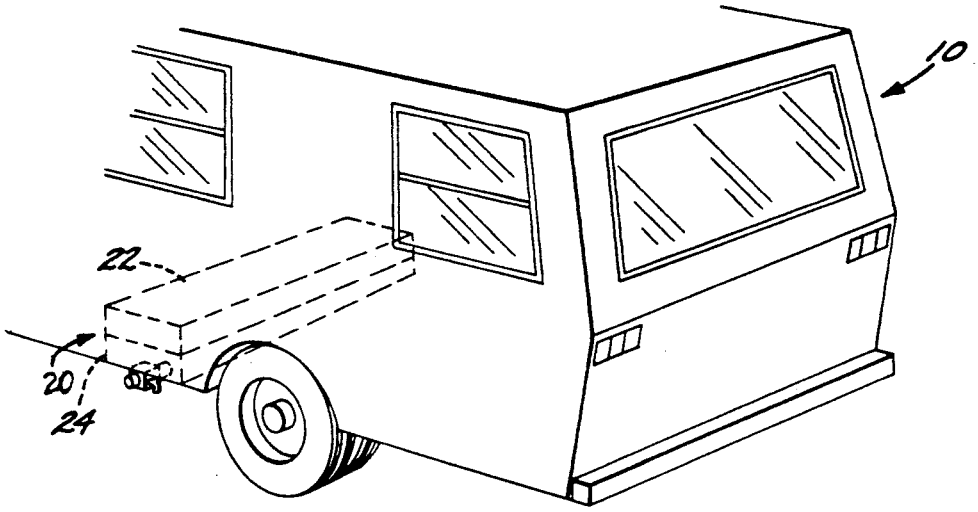
FIG. 1
FIG. 2
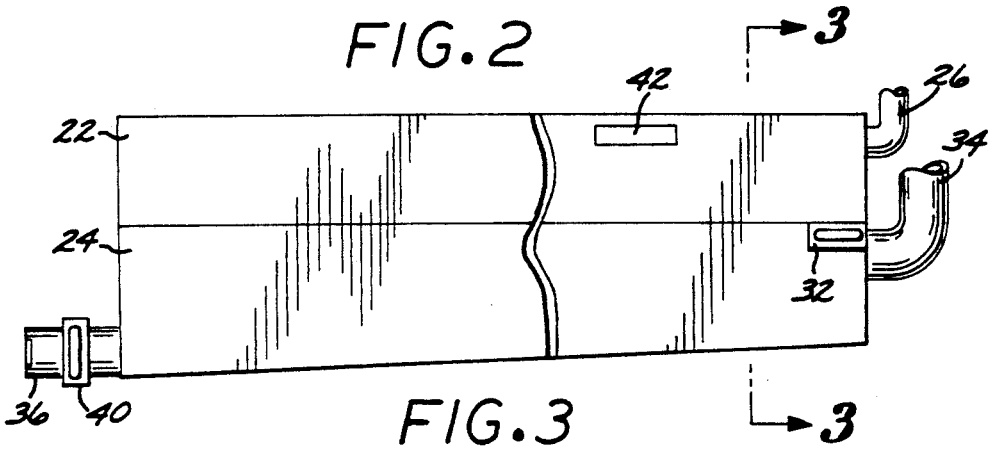
FIG. 3
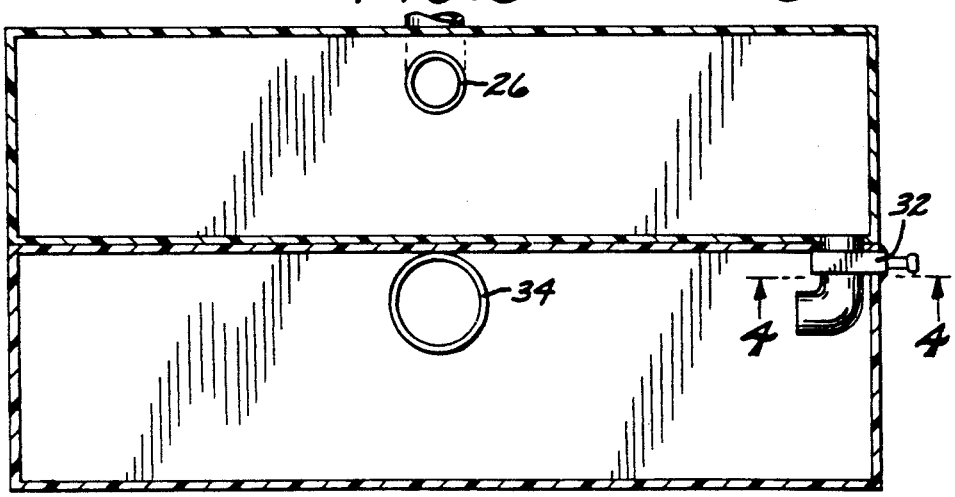

WASTE WATER DISPOSAL SYSTEM FOR RECREATIONAL VEHICLE

BACKGROUND OF THE INVENTION

The present invention relates to a system for disposing of waste water from the black and grey water holding tanks in a recreational vehicle (RV) in such a way as to flush the black water tank thoroughly.

The waste water in an RV is commonly referred to as grey water and black water. The grey water is the waste from the kitchen sink, dish washing water, and water from the bathroom sink and shower. The black water is the water and waste collected in its holding tank from the toilet.

At present these two types of waste water are handled separately in their respective holding tanks, and are joined by a "Y" connection in the sewer pipe only just before being let out of the RV into the sewer line. The two types of waste are not mixed until they come together in the sewer pipe.

The flushing of the toilet in an RV is not the same as flushing a conventional toilet. There is no accumulation of water held in a toilet tank which is released to facilitate the flush. The user steps on a valve or otherwise manually operates a valve to release water only while the valve is held open. The amount of water used in the flush can be as little as 10% of the amount of water used in a conventional toilet. Because of this, the black water tank has much less water than required to thoroughly flush the solids from the tank when emptying the tank.

U.S. Pat. No. 4,868,932 discloses a holding tank flushing system for a recreational vehicle which uses a supplementary self-contained cleaning fluid distribution system. This is an expensive solution to the problem of flushing the RV holding tanks. This patent does show the Y or T 18, at which the grey water and sewage lines 14 and 16 meet, as well as manually operated drain shut off valves 22 and 24 in each line.

U.S. Pat. No. 3,594,825 describes a water circulation system for a camper or boat, wherein grey water can be used to flush the toilet in order to conserve water usage.

It is therefore an object of the invention to provide a simple, inexpensive system for flushing the black water holding tank in recreational vehicles.

It is also an object of this invention to provide a waste water disposal system for recreational vehicles which employs grey water to flush the black water holding tank.

SUMMARY OF THE INVENTION

In accordance with the invention, a waste water disposal system for a recreational vehicle comprises a grey water holding tank and a black water holding tank. The grey water holding tank is positioned at a level above that of the black water tank. A grey water outlet is provided for selectively draining grey water from the grey water tank into the black water tank via gravity force. This may include, for example, an outlet pipe extending between a lower portion of the grey water tank and the black water tank. A shut-off valve operated by the vehicle user opens or closes the outlet so as to allow grey water to collect in the grey water tank or to drain the contents of the grey water tank into the black water tank. The system further comprises an outlet from the black water tank for selectively emptying the contents of the black water tank, including the grey water, into a collection facility. The grey water provides a substantially increased volume of flushing medium which helps to flush solids from the black water tank, without using fresh water or other flushing fluids.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a simplified schematic diagram illustrating a recreational vehicle embodying a waste water disposal system in accordance with the invention.

FIG. 2 is an elevation view of the grey water and black water holding tanks of the embodiment of FIG. 1.

FIG. 3 is a cross-sectional view taken along line 3—3 of FIG. 2.

DETAILED DESCRIPTION OF THE PREFERRED EMBODIMENT

Figures 4, 5, 6, 7:
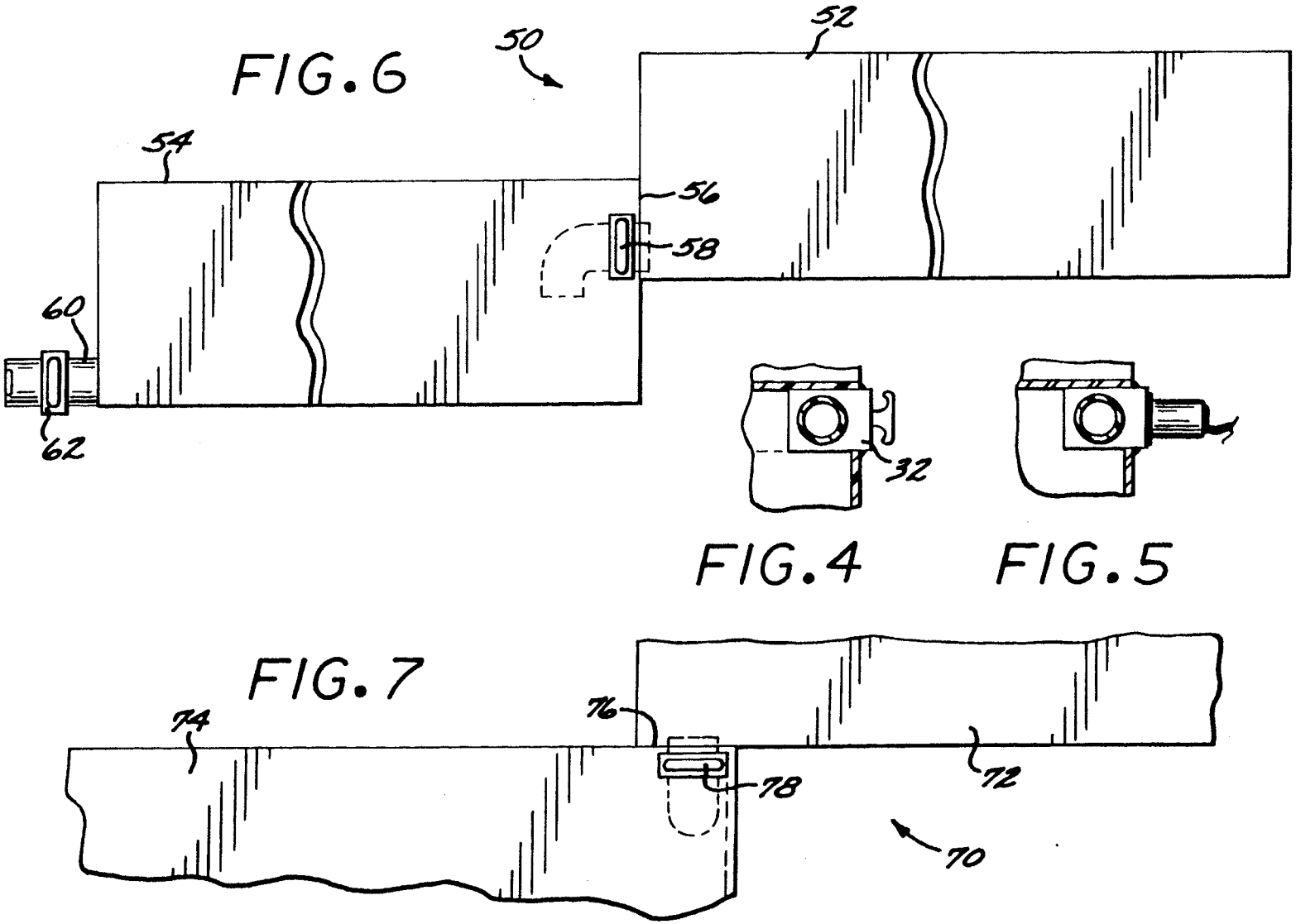
FIG. 4 is a cross-sectional view illustrating a manually operated shut-off valve which may be used to close the connection between the grey water tank and the black water tank in accordance with the invention.
FIG. 5 illustrates a solenoid-operated valve which may be used in place of the shut-off valve of FIG. 4.
FIGS. 6 and 7 illustrate respective first and second alternate arrangements of the grey water and black water holding tanks.

A waste water disposal system 20 for a recreational vehicle 10 is shown in FIGS. 1-3. In this embodiment, the grey water holding tank 22 and the black water holding tank 24 are stacked one on the other, with the grey water tank 22 above the black water tank 24. Grey water is admitted into the tank 22 through inlet pipe 26 from the grey water sources such as the sinks and shower. An outlet from the tank 22 is provided into tank 24 by means of a drain pipe 30 and a shut-off valve 32 which is operated by the RV owner or attendant. The grey water flows through the pipe 30 and valve 32 by the force of gravity when the valve 32 is open.

Black water is admitted into the tank 24 via inlet pipe 34 from the RV toilet in the conventional manner. An outlet pipe 36 provides an outlet to the collecting apparatus or sewer, through a shut-off valve 40.

The grey water tank 22 is provided with a gauge 42 which provides an indication, either visually or audibly, to the RV operator that the tank 22 is full. When the collection apparatus is connected to the sewer outlet pipe 36, the valves 32 and 40 are opened by the operator, permitting the grey water to empty into the black water tank 24, thereby providing a large quantity of flushing medium to thoroughly flush the tank 24. In the typical case, when the recreational vehicle is parked for an extended period and hooked up to a sewer line connection, the valve 40 will be left in the open position, allowing full time drainage from the black water holding tank 24, and the valve 32 will nominally be closed. Periodically, when the grey water tank 22 has filled up, as indicated by the gauge, 42 the valve 32 will be opened by the operator to empty the grey water into the black water tank 24, thereby flushing its contents through the open valve 40 and out into the sewer line connection. Of course, if the vehicle has been on the road, and is then parked and hooked up to the sewer connection, the valve 40 may first be opened to empty the black water tank 24 to the extent possible, and thereafter the valve 32 opened to flush out the black water tank 24 with the grey water.

The shut-off valves 32 and 36 may be manually operated, of the type shown in FIG. 4. Alternatively, electrically operated, solenoid-actuated valves of the type shown in FIG. 5 may be used, particularly for the valve 32, which may not be as readily accessible to the operator as the valve 36.

FIG. 6 shows an alternative embodiment of a waste water disposal system 50 embodying the invention. This system 50 is very similar to the system 20 of FIG. 1. However, the grey water tank 52 shares a common vertical wall portion 56 with the black water tank 54. An outlet from the grey water tank into the black water tank 54 is provided through a shut-off valve 58. An outlet pipe 60 provides a means of draining the black and grey water from the tanks 52 and 54 through a shut-off valve 62. The grey water tank 52 is elevated above virtually all the volume of the black water tank 54, so that grey water flows in the black water tank 54 via gravity.

FIG. 7 shows another alternative system 70 which is very similar to the system 50, except that the grey water tank 72 and black water tank 74 share a horizontal wall portion 76. Grey water flows through a valve 78 into the black water tank 74 via gravity. An outlet pipe (not shown in FIG. 7) permits the tanks to be emptied into a collection apparatus or sewer.

The present invention provides a simple, inexpensive and reliable solution to the problem of cleaning an RV black water holding tank. The invention is efficient since it makes use of grey water, which is being disposed of, to flush the black water tank. Therefore, the invention conserves water.

It is understood that the above-described embodiments are merely illustrative of the possible specific embodiments which may represent principles of the present invention. Other arrangements may readily by devised in accordance with these principles by those skilled in the art without departing from the scope and spirit of the invention.

What is claimed is:

1. A waste disposal system for a recreational vehicle characterized by a grey water holding tank and a black water holding tank, wherein the grey water holding tank is positioned at a level above that of the black water tank, the system including means for flushing the contents of said black water tank, comprising:

grey water outlet means for emptying the contents of said grey water tank into said black water tank via gravity force without passing through a vehicle toilet, said outlet means comprising a valve controllable by the vehicle operator; and an outlet from said black water holding tank for selectively emptying the contents of said black water holding tank, said contents including grey water admitted via said valve, thereby flushing the black water tank with said grey water as the contents of the black water holding tank are drained.

2. The system of claim 1 wherein said grey water outlet means comprises a pipe connecting between an opening formed in a lower wall or floor surface of said grey water holding tank and an opening formed in said black water tank, and said valve regulates the flow of grey water through said pipe into said black water tank.

3. The system of claim 1 wherein said grey water outlet means comprises an opening communicating between adjacent wall surfaces of said respective grey and black water holding tanks.

4. The system of claim 1 wherein said grey water outlet means comprises an opening communicating between adjacent horizontal surfaces comprising said respective grey and black water holding tanks.

5. The system of claim 1 wherein said outlet comprises a sewer pipe extending from said black water holding tank and a sewer valve for selectively opening said sewer pipe to drain the contents of said black water holding tank or closing said pipe.

6. The system of claim 1 further comprises a gauge for providing an indication that said grey water tank is full and should be emptied into said black water tank.

7. The system of claim 1 wherein said grey water outlet means comprises means for draining said tank contents when it is substantially full of grey water.

8. A recreational vehicle with a waste water disposal system, comprising:

a grey water holding tank for collecting grey waste water;

a black water holding tank for collecting black waste water;

a grey and black water disposal system for flushing said black water holding tank, comprising means for emptying the contents of said grey water tank into said black water tank without passing through a vehicle toilet; and means for draining the contents of said black water tank, including said grey water, into a collection apparatus, wherein the flow of said grey water through said black water tank helps to flush solids from said black water tank when disposing of said grey and black water.

9. In a vehicle characterized by a grey water holding tank and a black water holding tank, a method of flushing the black water tank, comprising a sequence of the following steps:

opening an outlet from the black water holding tank to empty by gravity the contents of said black water holding tank through said outlet; and releasing the contents of said grey water tank into said black water tank via a conduit between said grey water and said black water tanks and without passing through a vehicle toilet, to flush said black water tank with the contents of said grey water tank.

10. The method of claim 9 wherein said grey water holding tank is positioned at a level above that of said black water holding tank, said conduit is fitted with a valve, and said step of releasing the contents of said grey water tank comprises opening said valve to permit said contents of said grey water tank to be released into said black water tank.

11. The method of claim 9 wherein said outlet from said black water tank comprises a sewer pipe extending from said black water tank and a sewer valve, and said step of opening an outlet from said black water tank comprises opening said sewer valve.

* * * * *